US007624859B1

(12) United States Patent
Casanova et al.

(10) Patent No.: US 7,624,859 B1
(45) Date of Patent: Dec. 1, 2009

(54) SELF-STANDING ACTIVE FOOT FOR BLISTER PACKAGING

(75) Inventors: Julio C. Casanova, Avon Lake, OH (US); Cari Michelle Curtis, Saint Louis, MO (US); Mark J. Brennan, Asheboro, NC (US); Scott W. Osiecki, Skaneateles, NY (US); Mark A. Ferguson, Memphis, NY (US)

(73) Assignee: Eveready Battery Co., Inc., St. Louis, MO (US)

( * ) Notice: Subject to any disclaimer, the term of this patent is extended or adjusted under 35 U.S.C. 154(b) by 9 days.

(21) Appl. No.: 12/145,762

(22) Filed: Jun. 25, 2008

(51) Int. Cl.
*B65D 85/88* (2006.01)

(52) U.S. Cl. ..... 206/45.24; 206/705; 206/470; 53/484

(58) Field of Classification Search ..... 206/45.24, 206/703, 705, 461, 467, 470, 471, 775; 248/127, 248/371; 53/452, 456, 484, 485, 167
See application file for complete search history.

(56) References Cited

U.S. PATENT DOCUMENTS

| | | | | |
|---|---|---|---|---|
| 4,415,084 | A | 11/1983 | Hauser et al. | |
| 4,568,017 | A | 2/1986 | Grunert | |
| 4,784,268 | A | 11/1988 | Perchak | |
| 4,899,882 | A | 2/1990 | Benner | |
| 4,930,627 | A | 6/1990 | Borst et al. | |
| 4,962,849 | A | 10/1990 | Anderson | |
| 5,011,006 | A | 4/1991 | Anderson | |
| 5,012,927 | A | 5/1991 | Borst | |
| 5,038,936 | A * | 8/1991 | Borst | 206/470 |
| 5,147,035 | A | 9/1992 | Hartman | |
| 5,392,919 | A * | 2/1995 | Passamoni | 206/576 |
| 5,462,161 | A | 10/1995 | Halaburda et al. | |
| D393,799 | S | 4/1998 | Pope et al. | |
| 5,849,378 | A | 12/1998 | Gask | |
| 6,059,101 | A | 5/2000 | Gambardella et al. | |
| D432,909 | S | 10/2000 | Pirro et al. | |
| D433,629 | S | 11/2000 | Clarke et al. | |
| 6,244,444 | B1 | 6/2001 | Jacobus et al. | |
| 6,364,115 | B1 | 4/2002 | Casanova et al. | |
| 6,382,412 | B1 | 5/2002 | Wood | |
| 6,401,932 | B1 | 6/2002 | Weinstein et al. | |
| 6,427,841 | B2 | 8/2002 | Wani et al. | |
| 6,478,158 | B2 | 11/2002 | Gaffney et al. | |
| 6,679,630 | B2 | 1/2004 | Knoerzer et al. | |
| D489,253 | S | 5/2004 | Kumakura et al. | |
| D494,464 | S | 8/2004 | Kumakura et al. | |

(Continued)

FOREIGN PATENT DOCUMENTS

| | | |
|---|---|---|
| EP | 711713 | 3/1999 |

(Continued)

*Primary Examiner*—Jacob K Ackun, Jr.
(74) *Attorney, Agent, or Firm*—Russell H. Toye, Jr.

(57) ABSTRACT

A battery package capable of standing upright comprising a front member, a rear member pivotally connected to the front member, and a foot pivotally connected to a bottom of the rear member. The rear member and the front member have an open configuration and a closed configuration. The rear member and the front member are configured to capture batteries therebetween when in the closed configuration. The foot is pivoted to abut against a rear bottom portion of the rear member, thereby placing the foot in a support position such that the battery package can stand on a horizontal surface. The foot is maintained in the support position by adhesive.

36 Claims, 6 Drawing Sheets

U.S. PATENT DOCUMENTS

| | | | | |
|---|---|---|---|---|
| D497,547 | S | 10/2004 | Kumakura et al. | |
| D501,137 | S | 1/2005 | Fritz et al. | |
| 2001/0008240 | A1 | 7/2001 | Herrin | |
| 2002/0162771 | A1 | 11/2002 | Van Wagenen et al. | |
| 2004/0028855 | A1 | 2/2004 | Masuki et al. | |
| 2004/0214052 | A1 | 10/2004 | Rochelo | |
| 2005/0092644 | A1 * | 5/2005 | Cafferata et al. | 206/471 |
| 2006/0000738 | A1 | 1/2006 | Kumakura et al. | |

FOREIGN PATENT DOCUMENTS

| | | |
|---|---|---|
| GB | 2053836 | 2/1981 |
| GB | 2327939 | 2/1999 |
| GB | 2413315 | 10/2005 |
| GB | 2422140 | 7/2006 |
| JP | 8324636 | 12/1996 |
| JP | 11227828 | 8/1999 |
| JP | 2003252332 | 9/2003 |

* cited by examiner 10
12
14
18
20
22
24
26
28
32
34
37
38
39
40
60
66
68
70
76
82
84
86
88
90
92
94
96
98
100
104
106
110
120
122
123
124
125
126
130
132
136
142
150
200

86
110
202
200
66
68
84
108
62
64
10
24
104
44
60
14
80
102
98
100
54
26
20
12
40
52
32
39
96
78
38
30
98
37
28
96
98
39
90
38
50
96
98
38
39
34
96
42
72
70
48
144
92
94
142
58
56
39
46
134
142
114
34
98
126
74
112
140
116
82
138
118
128
18
140
16
125
122
130
124
122
132
76
120
204

152
150
154

SELF-STANDING ACTIVE FOOT FOR BLISTER PACKAGING

FIELD OF THE INVENTION

The present invention relates to packaging, and in particular to packaging for batteries.

SUMMARY OF THE PRESENT INVENTION

An aspect of the present invention is to provide a battery package capable of standing upright comprising a front member, a rear member pivotally connected to the front member, and a foot pivotally connected to a bottom of the rear member. The rear member and the front member have an open configuration and a closed configuration. The rear member and the front member are configured to capture batteries therebetween when in the closed configuration. The foot is pivoted to abut against a rear bottom portion of the rear member, thereby placing the foot in a support position such that the battery package can stand on a horizontal surface. The foot is maintained in the support position by adhesive.

Another aspect of the present invention is to provide a method of packaging batteries comprising forming a battery package comprising a front member, with a rear member pivotally connected to the front member and a foot pivotally connected to the rear member. The method also includes capturing batteries between the front member and the rear member including pivoting the front member relative to the rear member to move the battery package to a closed configuration. The method further includes pivoting the foot relative to the rear member such that the foot abuts a rear bottom portion of the rear member, thereby placing the foot in a support position such that the battery package can stand on a horizontal surface. The method also includes maintaining the foot in the support position by adhesive.

Yet another aspect of the present invention is to provide a battery package capable of standing upright comprising a front member, a rear member, batteries, a foot member and a strip of material. The front member has a front inside surface with front battery support structure. The rear member is pivotally connected to a side of the front member. The rear member has a rear inside surface with rear battery support structure. The rear member and the front member have an open configuration and a closed configuration. The batteries are captured between the front battery support structure of the front member and the rear battery support structure of the rear member. The foot is pivotally connected to a bottom of the rear member, with the foot being pivoted to abut against a rear bottom portion of the rear member, thereby placing the foot in a support position such that the battery package can stand on a horizontal surface. The strip of material is adhesively connected to both a rear surface of the rear member and the foot, thereby maintaining the foot in the support position.

These and other aspects, objects, and features of the present invention will be understood and appreciated by those skilled in the art upon studying the following specification, claims, and appended drawings.

DETAILED DESCRIPTION OF PREFERRED EMBODIMENTS

Figures 1, 7:
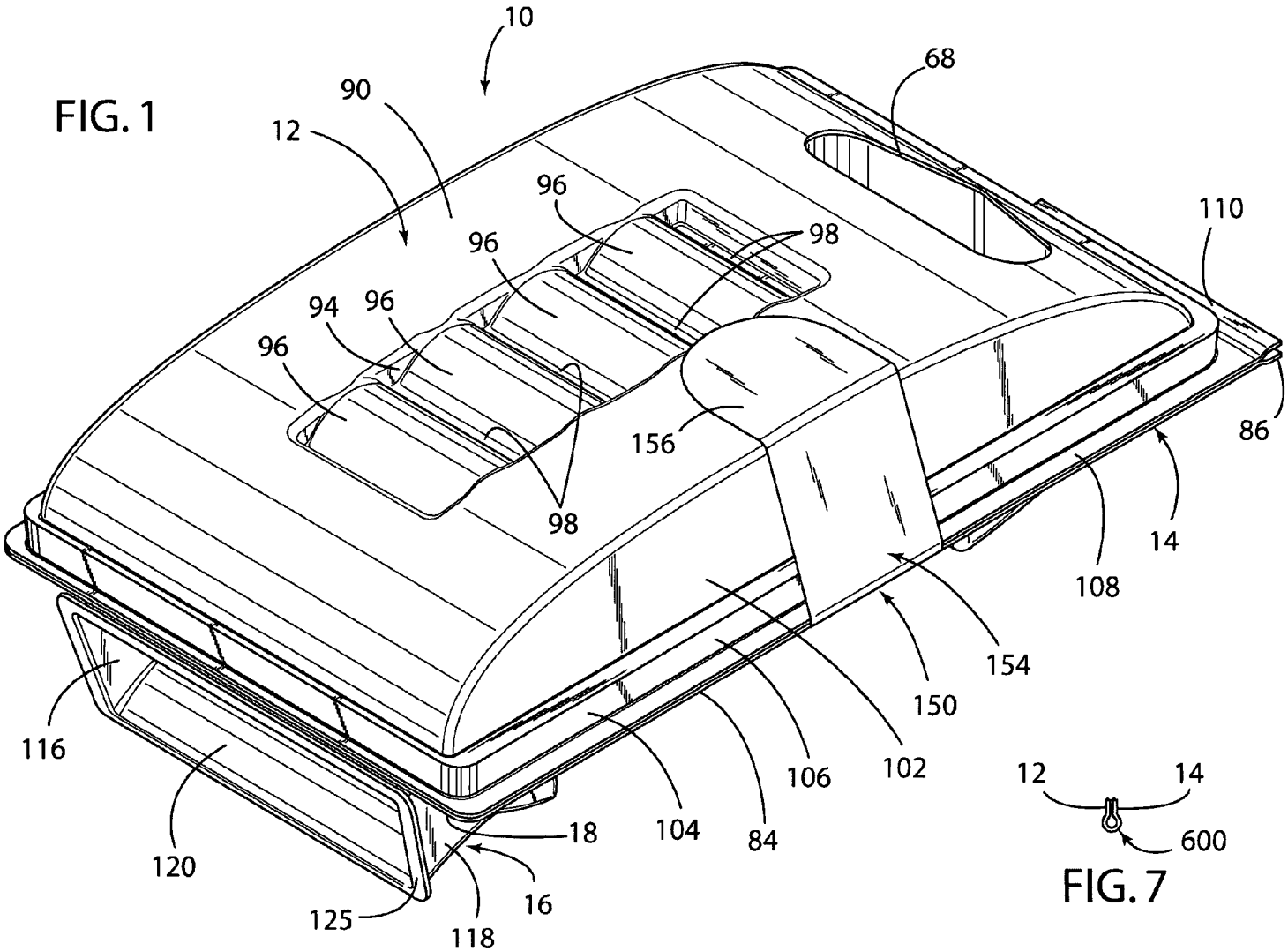
FIG. 1 is a perspective view of a battery package of the present invention in a closed configuration.
FIG. 7 is a close-up view of a pivot between a front member and a rear member of the battery package of the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIGS. 1-6) generally designates a battery package embodying the present invention. In the illustrated example, the battery package 10 is capable of standing upright and comprises a front member 12, a rear member 14 pivotally connected to the front member 12, and a foot 16 pivotally connected to a bottom 18 of the rear member 14. The rear member 14 and the front member 12 have an open configuration (see FIG. 3) and a closed configuration (see FIGS. 1-2). The rear member 14 and the front member 12 are configured to capture batteries 20 therebetween when in the closed configuration. The foot 16 is pivoted to abut against a rear bottom portion 22 of the rear member 14, thereby placing the foot 16 in a support position such that the battery package 10 can stand on a horizontal surface (see FIG. 2). The foot 16 is maintained in the support position by adhesive.

The illustrated batteries 20 within the battery package 10 can comprise electrochemical cells for supplying voltage to battery powered devices. The batteries 20 can comprise any of the popular alkaline or lithium cells of the generally cylindrical shape that are commercially available in industry-recognized, standard sizes, including D-, C-, AA-, AAA-, and AAAA-size cells, as well as other sizes and configurations (e.g., 9 volt batteries). Alternatively, disc-shaped batteries commercially available for small electrically operated devices, such as hearing aids, could be used. In the illustrated embodiment, the battery package 10 includes eight cylindrical batteries 20 therein in a two horizontal by four vertical matrix (see FIG. 4). However, it is contemplated that the battery package 10 could include any number of batteries 20 therein. Furthermore, it is contemplated that the battery package 10 could include different batteries 20 and/or a plurality of different size batteries 20.

Figure 4:
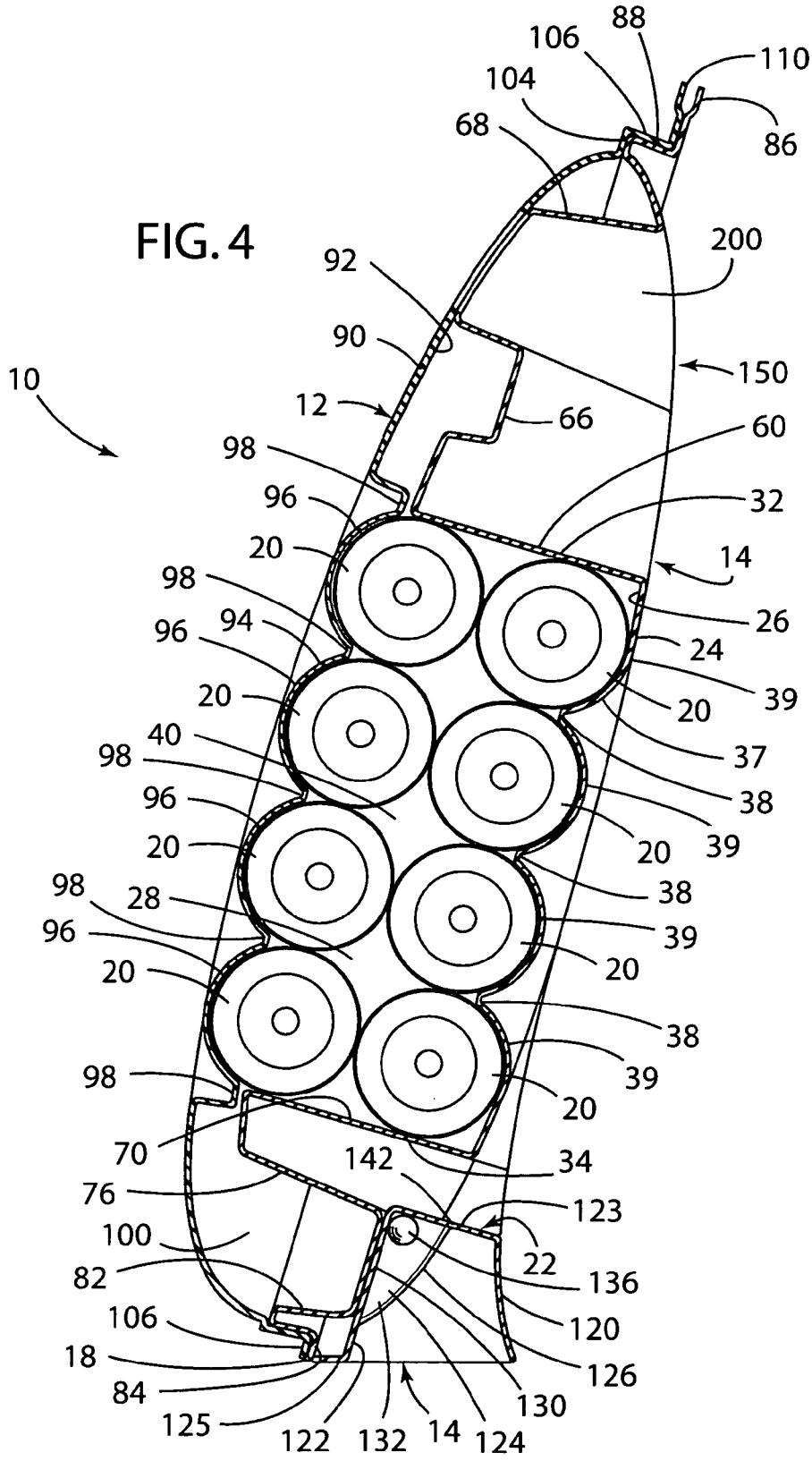
FIG. 4 is a cross-sectional side view of the battery package of the present invention in the closed configuration.

The illustrated rear member 14 is configured to support the batteries 20 from the rear. The rear member 14 includes an arcuate rear section 24 having a front surface 26 for accepting the batteries 20 thereon. In the illustrated embodiment, the batteries 20 comprise four cylindrical batteries. However, as discussed above, any number and shape of batteries could be used. As illustrated in FIG. 4, the batteries 20 are positioned to abut the front surface 26 of the rear section 24 of the rear member 14. The batteries 20 are aligned vertically above one another with their cylindrical tubes being positioned horizontally. Outer surfaces of the cylindrical tubes of the batteries abut against the front surface 26 of the rear section 24 of the rear member 14. For example, the front surface 26 of the rear section 24 of the rear member 14 can include a shelf 37 having four curved battery receiving surface portions 39 defining wedge-shaped ribs 38. The curved battery receiving surface portions 39 receive the batteries 20 thereon and the wedge-shaped ribs 38 are located between the batteries 20. As illustrated in FIG. 4, a top stay member 32 abuts against the top battery 20 and a bottom stay member 34 abuts against the bottom battery 20. The batteries 20 are also maintained in position within the rear member 14 by a first side stay member 28 and a second side stay member 30. The first side stay member 28, the second side stay member 30, the top stay member 32, and the bottom stay member 34 surround the batteries 20 within the rear member 14.

In the illustrated example, first side stay member 28, the second side stay member 30, the top stay member 32, and the bottom stay member 34 of the rear member 14 extend forwardly from the front surface 26 of the arcuate rear section 24. The first stay member 28 includes an inside wall 40, an outside wall 42, a top wall 44, a bottom wall 46 and a front wall 48. The inside wall 40, the outside wall 42, the top wall 44 and the bottom wall 46 of the first stay member 28 end at the front wall 48, with the front wall 48 forming a substantially planar surface. The inside wall 40 of the first stay member 28 is configured to abut against a first end of the batteries 20. The second stay member 30 includes an inside wall 50, an outside wall 52, a top wall 54, a bottom wall 56 and a front wall 58. The inside wall 50, the outside wall 52, the top wall 54 and the bottom wall 56 of the second stay member 30 end at the front wall 58, with the front wall 58 forming a substantially planar surface. The inside wall 50 of the second stay member 30 is configured to abut against a second end of the batteries 20. The top stay member 32 includes a bottom wall 60, a first side wall 62, a second side wall 64 and a stepped front surface 66. The first side wall 62 and the second side wall 64 are connected at tops thereof to a hanging opening tube 68, which is used to hang the battery package 10 on a rod and is discussed in more detail below. The stepped front surface 66 is also connected to the hanging opening tube 68. The bottom wall 60 of the top stay member 32 abuts against the top battery 20. The bottom stay member 34 includes a top wall 70, a first side wall 72, a second side wall 74 and a stepped front surface 76. The top wall 70 of the bottom stay member 34 abuts against the bottom battery 20.

The illustrated rear member 14 can also include a structure for providing stability to and for supporting the battery package 10. For example, the rear member 14 can include a first side wall 78 connected to a first side of the arcuate rear section 24 and a second side wall 80 connected to a second side of the arcuate rear section 24. The first side wall 78 can also be connected to the first sides of the bottom wall 46 and the top wall 44 of the first stay member 28. Likewise, the second side wall 80 can also be connected to the second sides of the bottom wall 56 and the top wall 54 of the second stay member 30. Front edges of the first side wall 78 and the second side wall 80, the top and bottom of the arcuate rear section 24, the bottom of the outside wall 42 of the first side stay member 28 and the bottom of the outside wall 52 of the second side stay member 30 connects to a peripheral inverted J-shaped step 82 for providing support to the battery package 10 and for assisting in maintaining the battery package 10 in the closed position as discussed in more detail below. The peripheral inverted J-shaped step 82 forms a substantially rectangular surface 88 that tapers from a larger area in a front of the rear member 14 to a smaller area in the rear of the rear member 14. A planar rim 84 is connected to the peripheral inverted J-shaped step 82 at the smaller area of the rectangular surface 88. The planar rim 84 can include a pull tab extension 86 allowing a user of the battery package 10 to easily grip the rear member 14 for moving the battery package 10 to the open position. The front member 12 of the battery package 10 is pivotally connected to the first side of the planar rim 84 of the rear member 14.

In the illustrated example, the front member 12 is configured to support the batteries 20 from the front. The front member 12 includes an arcuate front section 90 having a rear surface 92 for accepting the batteries 20 thereon. As illustrated in FIG. 4, the batteries 20 are positioned to abut the rear surface 92 of the front section 90 of the front member 12. Outer surfaces of the cylindrical tubes of the batteries abut against the rear surface 92 of the front section 90 of the front member 12. For example, the rear surface 92 of the front section 90 of the front member 12 can include a shelf 94 having four curved battery receiving surface portions 96 defining wedge-shaped ribs 98. The curved battery receiving surface portions 96 receive the batteries 20 thereon and the wedge-shaped ribs 98 are located between the batteries 20 and outside of the top and bottom batteries. As illustrated in FIG. 4, the batteries 20 are captured between the front member 12 and the rear member 14 and are located between the rear surface 92 of the arcuate front section 90 of the front member 12, the front surface 26 of the arcuate rear section 24 of the rear member 14, the first side stay member 28, the second side stay member 30, the top stay member 32 and the bottom stay member 34 when the battery package 10 is in the closed configuration.

The illustrated front member 12 can also include a structure for providing stability to and for supporting the battery package 10. For example, the front member 12 can include a first side wall 100 connected to a first side of the arcuate front section 90 and a second side wall 102 connected to a second side of the arcuate front section 90. Front edges of the first side wall 100 and the second side wall 102 as well as the top and bottom of the arcuate front section 90 connect to a peripheral inverted L-shaped step 104 for providing support to the battery package 10 and for assisting in maintaining the battery package 10 in the closed position as discussed in more detail below. The peripheral inverted L-shaped step 104 forms a substantially rectangular surface 106 that tapers from a larger area in a front of the front member 12 to a smaller area in the rear of the front member 12. A planar rim 108 is connected to the peripheral inverted L-shaped step 104 at the smaller area of the rectangular surface 106. The planar rim 108 can include a pull tab extension 110 allowing a user of the battery package 10 to easily grip the front member 12 for moving the battery package 10 to the open position.

Figure 3:
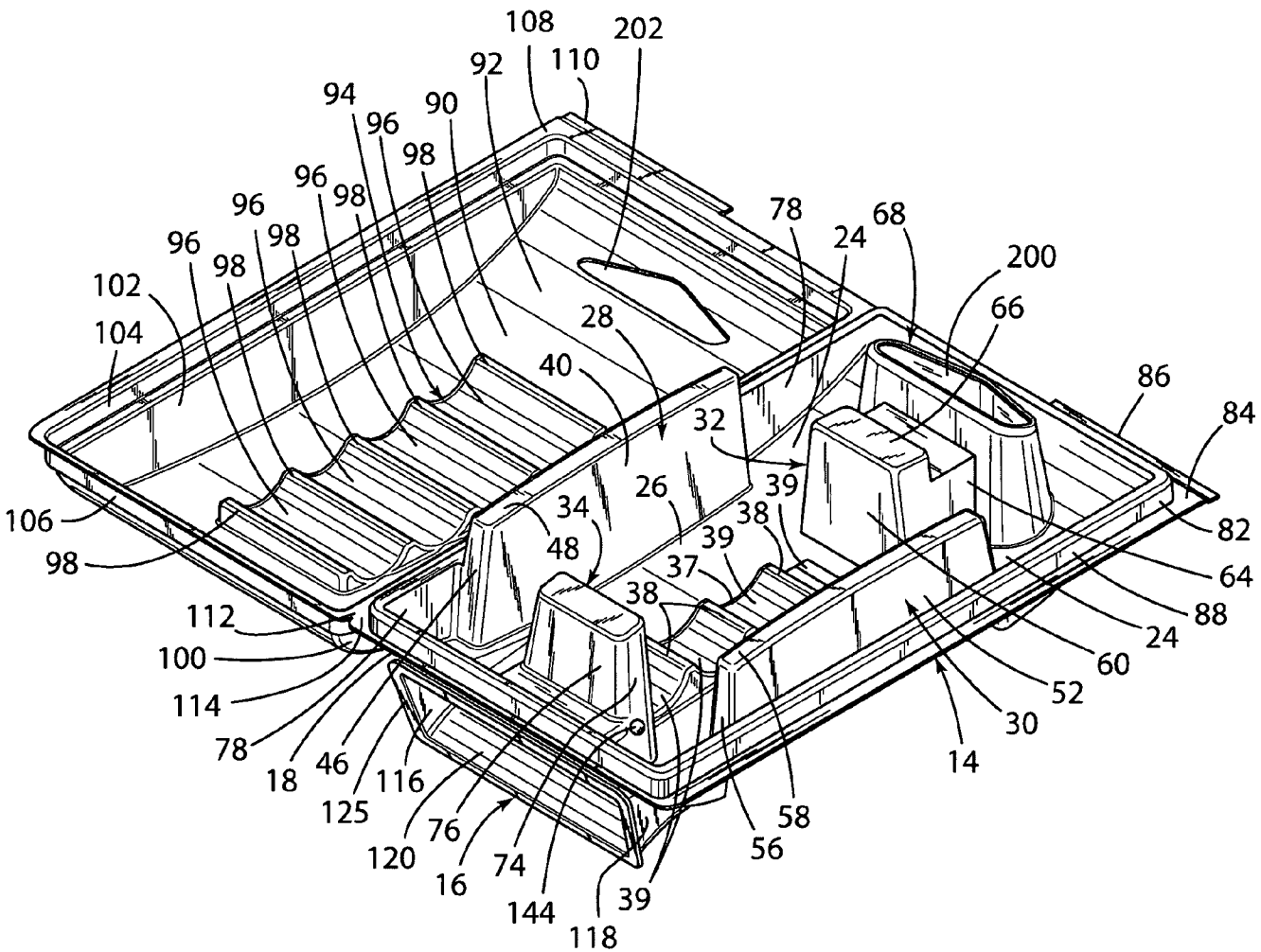
FIG. 3 is a perspective view of the battery package of the present invention in an open configuration.
Figure 5:
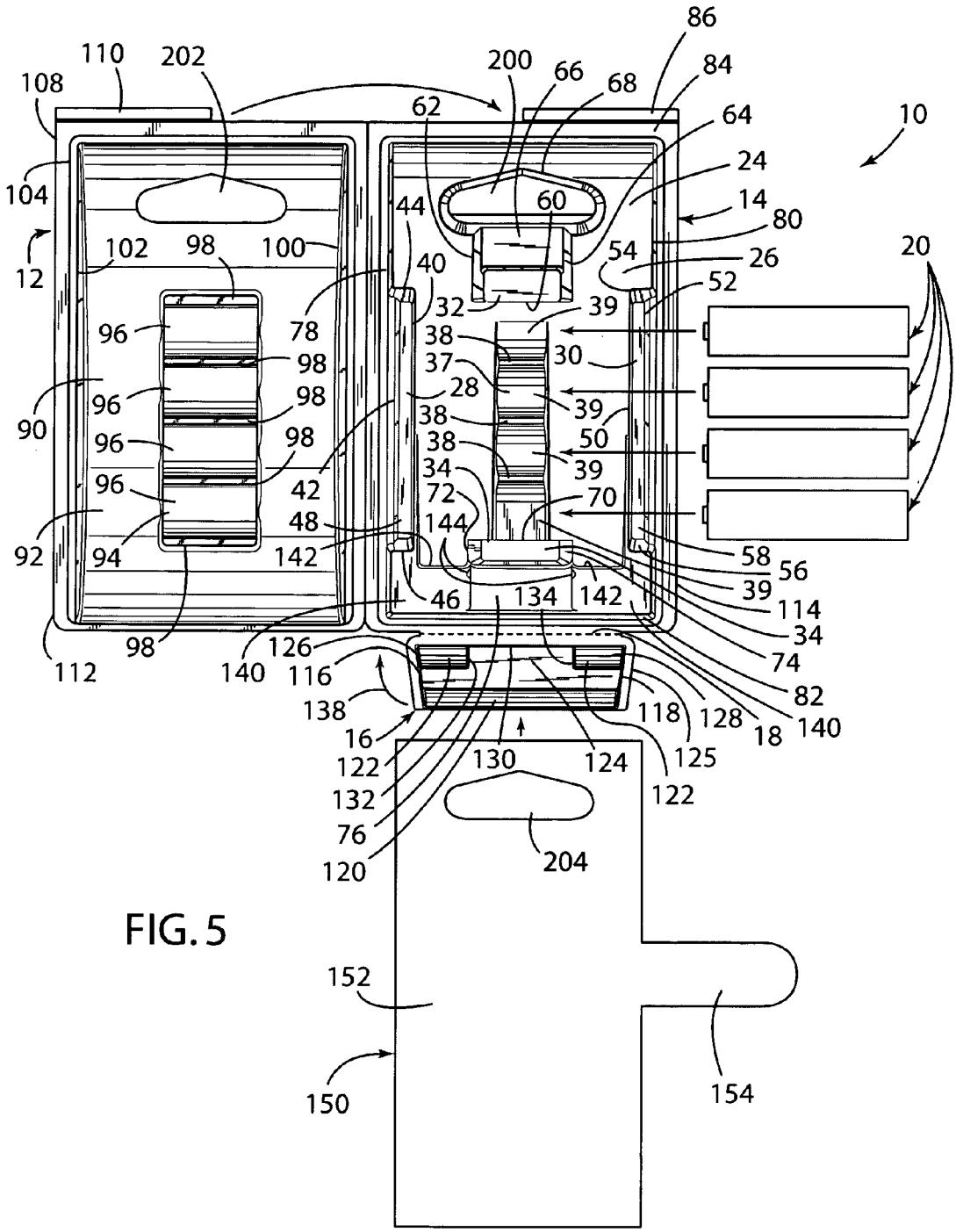
FIG. 5 is an exploded front view of the battery package of the present invention in the open position.

In the illustrated example, the front member 12 is configured to rotate relative to the rear member 14 to move the battery package 10 between the open configuration and the closed configuration. As illustrated in FIGS. 3 and 5, a first side 112 of the front member 12 is pivotally connected to a first side 114 of the rear member 14 by having the planar rim 108 of the front member 12 at the first side 112 being connected to the planar rim 84 of the rear member 14 at the first side 112. The planar rim 108 of the front member 12 can be connected to the planar rim 84 of the rear member 14 by a living hinge. It is further contemplated that the planar rim 108 of the front member 12 can be connected to the planar rim 84 of the rear member 14 via tape or any other connection means forming the hinge. The hinge allows the front member 12 to be rotated relative to the rear member 14. Furthermore, the front member 12 is configured to be at least partially locked to the rear member 14 in the closed configuration. In the illustrated embodiment, the rectangular surface 88 of the J-shaped step 82 of the rear member 14 is configured to be accepted within the rectangular surface 106 of the L-shaped step 104 of the front member 12 (see FIG. 4). Moreover, at least one side of both the rectangular surface 88 of the J-shaped step 82 of the rear member 14 and the rectangular surface 106 of the L-shaped step 104 of the front member 12 can be tapered towards the rear. For example, all four sides of both the rectangular surface 88 of the J-shaped step 82 of the rear member 14 and the rectangular surface 106 of the L-shaped step 104 of the front member 12 can be tapered towards the rear (e.g., like the sides of a pyramid). Accordingly, when the battery package is moved to the closed configuration from the open configuration, the rectangular surface 106 of the L-shaped step 104 of the front member 12 will snap over the rectangular surface 88 of the J-shaped step 82 of the rear member 14, thereby at least partially locking the battery package 10 in the closed position.

Figure 2:
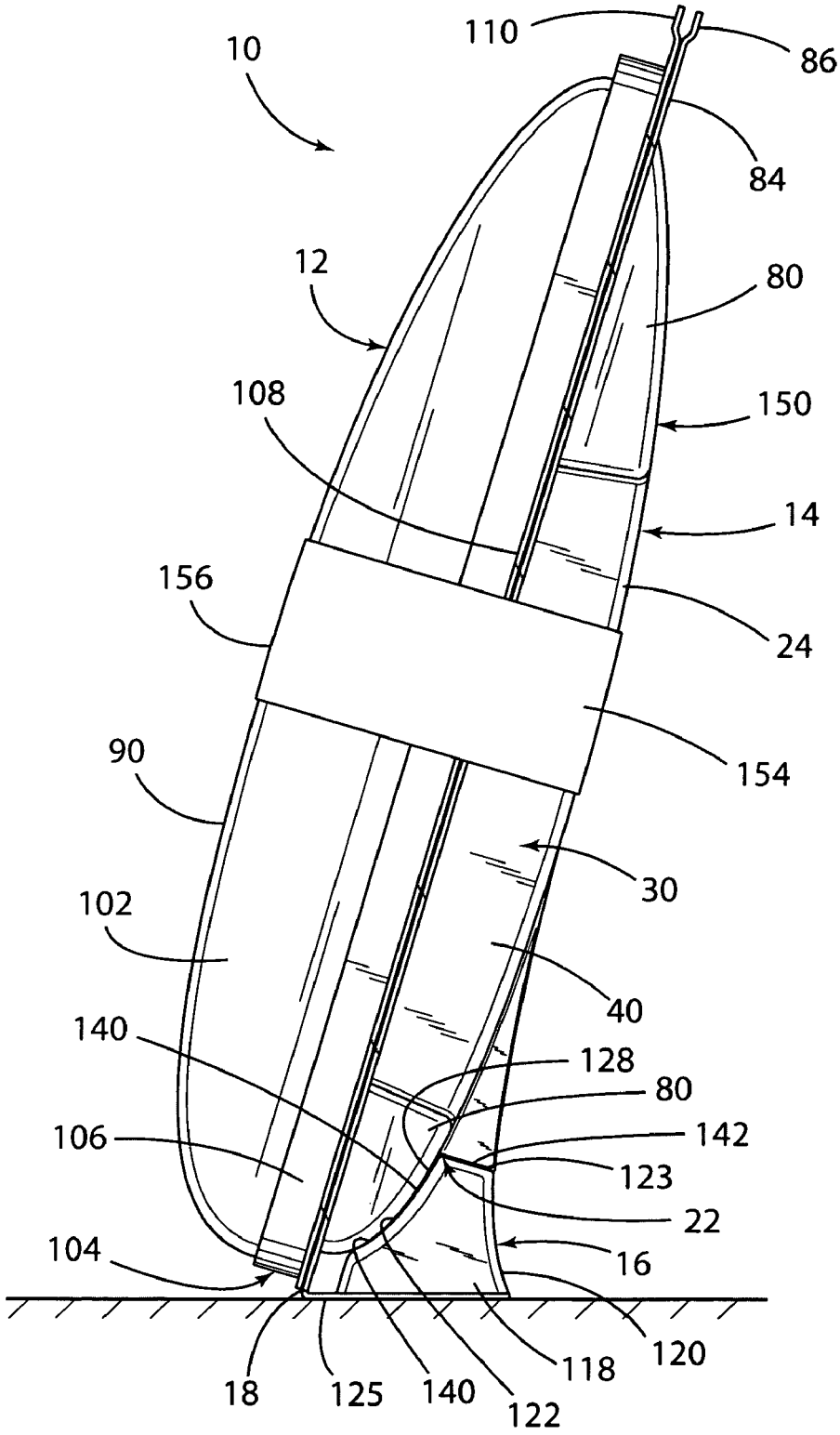
FIG. 2 is a side view of the battery package of the present invention in the closed configuration.

The illustrated battery package 10 also includes the foot 16 allowing the battery package 10 to stand on a horizontal surface (see FIG. 2). The foot 16 includes a first side wall 116, a second side wall 118, a rear wall 120 and a front wall 122. The foot 16 also includes a top surface 123 at tops of the first side wall 116, the second side wall 118, the rear wall 120 and the front wall 122. The foot 16 also includes a planar peripheral rim 125 at bottoms of the first side wall 116, the second side wall 118, the rear wall 120 and the front wall 122. The front wall 122 includes a wedge member 124 extending outwardly therefrom, with the wedge member 124 dividing the front wall 122 into a first side arcuate front surface 126 and a second side arcuate front surface 128. The wedge member 124 includes a front border surface 130, a first side border surface 132 and a second side border surface 134. Each of the first side border surface 132 and the second side border surface 134 includes at least one projection 136, with the projection 136 of the first side border surface 132 extending in a direction opposite to the projection 136 of the second side border surface 134. The wedge member 124 is configured to be inserted into an area of the rear member 14 behind the bottom stay member 34 and the foot 16 is configured to interact with the rear member 14 of the battery package to allow the battery package 10 to stand on the horizontal surface.

Figure 6:
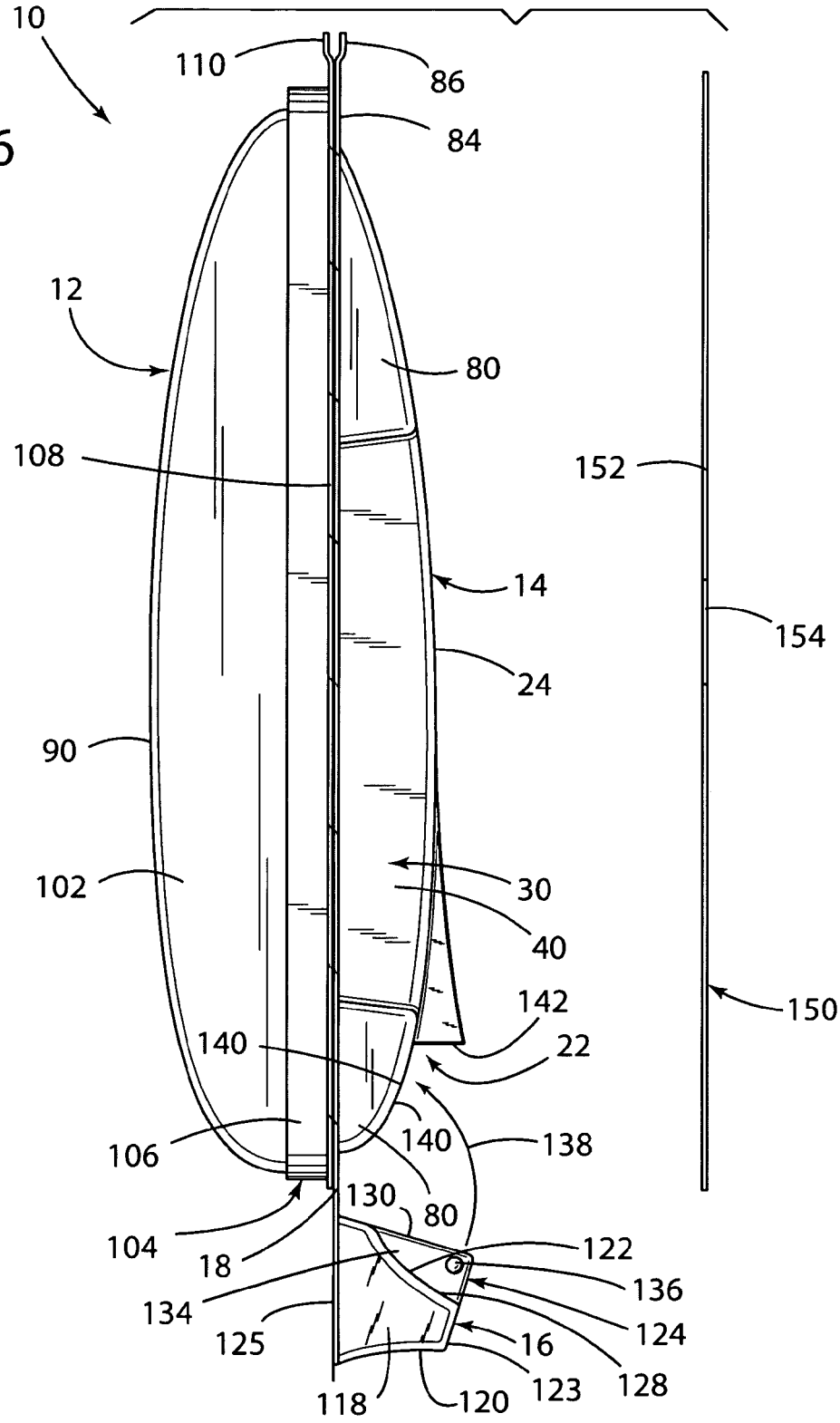
FIG. 6 is an exploded side view of the battery package of the present invention in the closed position.

In the illustrated example, the foot 16 is pivotally connected to the bottom 18 of the rear member 14 and the foot 16 is pivoted to abut against the rear bottom portion 22 of the rear member 14, thereby placing the foot 16 in the support position such that the battery package 10 can stand on the horizontal surface (see FIG. 2). As illustrated in FIG. 6, the foot 16 is pivoted about the bottom 18 of the rear member 14 along line 138. As the foot 16 is pivoted to abut against the rear bottom portion 22 of the rear member 14, the wedge member 124 will be inserted into an area of the rear member 14 behind the bottom stay member 34. Therefore, the first side arcuate front surface 126 and the second side arcuate front surface 128 of the front surface 122 of the foot 16 will abut against a bottom rear portion 140 of the arcuate rear section 24 of the rear member 14. Moreover, the top surface 123 of the foot 16 will abut against a pair of foot abutment ledges 142 extending from the arcuate rear section 24 of the rear member 14. Moreover, the projections 136 extending from the first side border surface 132 and the second side border surface 134 of the wedge member 124 of the foot 16 will snap into and extend into notches 144 in the first side wall 72 and the second side wall 74 of the bottom stay member 34 of the rear member 14, thereby assisting in maintaining the foot 16 against the rear member 14. While it is illustrated that when the foot 16 is in the support position, the foot is the only portion of the battery package 10 touching the horizontal surface (as illustrated in FIG. 2), it is contemplated that other portions of the battery package 10 could also contact the horizontal surface.

The illustrated foot 16 is maintained in the support position by adhesive. In one embodiment, the foot 16 is maintained in the support position by applying adhesive directly to the foot 16 and/or the rear member 14 at least one of the points that the foot 16 abuts the rear member 14 (e.g., the ledges 142 on the rear member 14 and the top surface 123). Alternatively, a strip of material 150 can be adhesively connected to both a rear surface of the rear member 14 and the foot 16 to thereby maintain the foot 16 in the support position. The strip of material 150 can have an adhesive applied to a front surface 152 thereof. The strip of material 150 is then applied to the rear surface of the arcuate rear section 24 of the rear member 14 and the rear wall 120 of the foot 16. It is contemplated that the adhesive could be applied to the rear surface of the arcuate rear section 24 of the rear member 14 and the rear wall 120 of the foot 16 instead of or in addition to any adhesive applied to the strip of material 150. Furthermore, it is contemplated that the adhesive applied to the strip of material 150 could be non-releasable. It is also contemplated that the strip of material 150 could include a release tab 154 having a pull area 156, with the release tab 154 extending around a side of the battery package 10 in the closed position and abutting against a front of the front member as illustrated in FIGS. 1 and 2. The pull area 156 can have a releasable adhesive applied thereto, thereby providing extra locking force for maintaining the battery package 10 in the closed configuration when the pull area 156 is against the front face of the front member 12. The pull area 156 can be removed from the front of the front member 12 and pull to thereby assist in opening the battery package 10. It is contemplated that the strip of material 150 could be made of any material (e.g., paper, plastic, film).

In the illustrated example, the battery package 10 can include a feature for allowing the battery package 10 to be hung from a display rack (not shown) in addition to being able to stand on a support surface. The battery package 10 includes the hanging opening tube 68 in the rear member 14. The hanging opening tube 68 includes a central opening 200 and the front member 12 includes an aperture 202 aligned with the central opening 200 of the hanging opening tube 68 for accepting a hanger rod (not shown) typically used to display batteries in a store as is well known to those skilled in the art. The strip of material 150 can also include an opening 204 aligned with the aperture 202 and the central opening 200 of the hanging opening tube 68 to allow the rod to extend through the strip of material 150.

The illustrated battery package 10 can be easily formed and batteries can easily be packaged in the battery package 10. It is contemplated that the front member 12, the rear member 14 and the foot 16 can be formed as one piece and folded relative to each other. For example, the front member 12, the rear member 14 and the foot 16 can be thermoformed. The foot 16 can then be pivoted relative to the rear member 14 along line 138 as discussed above. The foot 16 can then be maintained in a support position using adhesive as discussed above. The batteries 20 can also be placed onto the rear member 14 and the battery package 10 can be moved to the closed configuration to thereby package the batteries 20 in the battery package 10. It is contemplated that the pivot line between the front member 12 and the rear member 14 and the pivot line between the rear member 14 and the foot 16 can be perforated or weakened to allow the elements to easily pivot relative to each other. It is also contemplated that the front member 12 and the rear member 14 could have a C-shaped pivot 600 to allow the front member 12 to pivot relative to the rear member 14 (see FIG. 7).

It is to be understood that variations and modifications can be made on the aforementioned structure without departing from the concepts of the present invention. For example, it is contemplated that the battery package 10 can be formed of any formable material (e.g., plastic) and can be formed or molded in any manner. Furthermore, it is contemplated that any portion or the entire battery package 10 can be transparent, translucent or opaque. It is also contemplated that stickers can be placed on the front member 12 for advertising or informational purposes. It is further contemplated that the surface portions 39 and 96 can have a radius corresponding to the surface of the batteries 20 in the battery package, could be square or any other shape depending on the batteries (e.g., square for accepting 9-volt batteries thereon), or can be vertically or horizontally orientated. Furthermore, it is contemplated that the battery package 10 can be inclined on the support surface (as illustrated in FIG. 2) or can be vertical relative to the support surface. Therefore, it is to be understood that such concepts as described herein are intended to be covered by the following claims unless these claims by their language expressly state otherwise.

We claim:

1. A battery package capable of standing upright comprising:

a front member;

a rear member pivotally connected to the front member;

the rear member and the front member having an open configuration and a closed configuration, the rear member and the front member being configured to capture batteries therebetween when in the closed configuration; and a foot pivotally connected to a bottom of the rear member, the foot being pivoted to abut against a rear bottom portion of the rear member, thereby placing the foot in a support position such that the battery package can stand on a horizontal surface;

wherein the foot is maintained in the support position by adhesive.

2. The battery package of claim 1, wherein:

the rear member is pivotally connected to the front member along a first hinge;

the foot is pivotally connected to the bottom of the rear member along a second hinge; and the first hinge and the second hinge are co-planar.

3. The battery package of claim 1, wherein:

a strip of material is adhesively connected to both a rear surface of the rear member and the foot, thereby maintaining the foot in the support position.

4. The battery package of claims 3, wherein:

the strip of material is connected to both the rear surface of the rear member and the foot by a permanent adhesive.

5. The battery package of claim 4, wherein:

the strip of material includes a pull tab extending around a side of the battery package and releasably connected to the front member by a releasable adhesive.

6. The battery package of claim 1, wherein:

the foot is configured to allow the battery package to stand on the horizontal surface with the foot being the only portion of the battery package touching the horizontal surface.

7. The battery package of claim 1, wherein:

the foot includes at least one projection configured to be located in a notch on the rear member when the foot is abutted against the rear member, thereby assisting in maintaining the foot in the support position.

8. The battery package of claim 1, wherein:

the front member and the rear member each include arcuate surface portions for accepting batteries and maintaining the batteries in position within the battery package.

9. The battery package of claim 1, wherein:

the front member includes an aperture therethrough;

the rear member includes an opening therethrough; and the aperture of the front member and the opening of the rear member are aligned to allow the battery package to be hung from a support rod.

10. The battery package of claim 1, wherein:

the front member and the rear member includes engaging surfaces for locking the battery package in the closed configuration.

11. The battery package of claim 10, wherein:

the engaging surfaces each form four sides of a truncated pyramid.

12. The battery package of claim 1, wherein:

the rear member includes stays for maintaining batteries in position within the battery package.

13. A method of packaging batteries comprising:

forming a battery package comprising a front member, a rear member pivotally connected to the front member and a foot pivotally connected to the rear member;

capturing batteries between the front member and the rear member including pivoting the front member relative to the rear member to move the battery package to a closed configuration;

pivoting the foot relative to the rear member such that the foot abuts a rear bottom portion of the rear member, thereby placing the foot in a support position such that the battery package can stand on a horizontal surface; and maintaining the foot in the support position by adhesive.

14. The method of packaging batteries of claim 13, wherein:

forming comprises thermoforming.

15. The method of packaging batteries of claim 13, wherein:

the rear member is pivotally connected to the front member along a first hinge;

the foot is pivotally connected to the bottom of the rear member along a second hinge; and the first hinge and the second hinge are co-planar.

16. The method of packaging batteries of claim 13, further including:

adhering a strip of material to both a rear surface of the rear member and the foot, thereby maintaining the foot in the support position.

17. The method of packaging batteries of claim 16, wherein:

adhering comprises adhering the strip of material to both the rear surface of the rear member and the foot by a permanent adhesive.

18. The method of packaging batteries of claim 17, wherein:

the strip of material includes a pull tab;

and further including extending the pull tab around a side of the battery package and releasably connecting the pull tab to the front member by a releasable adhesive.

19. The method of packaging batteries of claim 13, wherein:

the foot is configured to allow the battery package to stand on the horizontal surface with the foot being the only portion of the battery package touching the horizontal surface.

20. The method of packaging batteries of claim 13, wherein:

the foot includes at least one projection;

and further including locating the at least one projection in a notch on the rear member when the foot is abutted against the rear member, thereby assisting in maintaining the foot in the support position.

21. The method of packaging batteries of claim 13, wherein:

the front member and the rear member each include arcuate surface portions for accepting batteries and maintaining the batteries in position within the battery package.

22. The method of packaging batteries of claim 13, wherein:

the front member includes an aperture therethrough;

the rear member includes an opening therethrough; and the aperture of the front member and the opening of the rear member are aligned to allow the battery package to be hung from a support rod.

23. The method of packaging batteries of claim 13, wherein:

the front member and the rear member includes engaging surfaces for locking the battery package in the closed configuration.

24. The method of packaging batteries of claim 23, wherein:

the engaging surfaces each form four sides of a truncated pyramid.

25. The method of packaging batteries of claim 13, wherein:

the rear member includes stays for maintaining batteries in position within the battery package.

26. A battery package capable of standing upright comprising:

a front member having a front inside surface with front battery support structure;

a rear member pivotally connected to a side of the front member, the rear member having a rear inside surface with rear battery support structure;

the rear member and the front member having an open configuration and a closed configuration;

batteries captured between the front battery support structure of the front member and the rear battery support structure of the rear member;

a foot pivotally connected to a bottom of the rear member, the foot being pivoted to abut against a rear bottom portion of the rear member, thereby placing the foot in a support position such that the battery package can stand on a horizontal surface; and a strip of material adhesively connected to both a rear surface of the rear member and the foot, thereby maintaining the foot in the support position.

27. The battery package of claim 26, wherein:

the rear member is pivotally connected to the front member along a first hinge;

the foot is pivotally connected to the bottom of the rear member along a second hinge; and the first hinge and the second hinge are co-planar.

28. The battery package of claim 26, wherein:

the strip of material is connected to both the rear surface of the rear member and the foot by a permanent adhesive.

29. The battery package of claim 28, wherein:

the strip of material includes a pull tab extending around a side of the battery package and releasably connected to the front member by a releasable adhesive.

30. The battery package of claim 26, wherein:

the foot is configured to allow the battery package to stand on the horizontal surface with the foot being the only portion of the battery package touching the horizontal surface.

31. The battery package of claim 26, wherein:

the foot includes at least one projection configured to be located in a notch on the rear member when the foot is abutted against the rear member, thereby assisting in maintaining the foot in the support position.

32. The battery package of claim 26, wherein:

the front battery support structure and the rear battery support structure comprise arcuate surface portions for accepting the batteries.

33. The battery package of claim 32, wherein:

the front battery support structure and the rear battery support structure further comprise stays for maintaining batteries in position within the battery package.

34. The battery package of claim 26, wherein:

the front member includes an aperture therethrough;

the rear member includes an opening therethrough; and the aperture of the front member and the opening of the rear member are aligned to allow the battery package to be hung from a support rod.

35. The battery package of claim 26, wherein:

the front member and the rear member includes engaging surfaces for locking the battery package in the closed configuration.

36. The battery package of claim 35, wherein:

the engaging surfaces each form four sides of a truncated pyramid.

* * * * *